US006766678B1

(12) United States Patent
Schulze et al.

(10) Patent No.: US 6,766,678 B1
(45) Date of Patent: Jul. 27, 2004

(54) PROCESS FOR DEFORMING A PIECE OF THIN-WALLED METAL TUBE

(75) Inventors: Bernd Schulze, Niederdorf (DE); Hendrik Bart Van Veldhuizen, Beverwijk (NL)

(73) Assignees: Dr. Meleghy GmbH & Co. KG, Bergisch Gladbach (DE); Corus Staal BV, CA Ijmuiden (NL)

( * ) Notice: Subject to any disclaimer, the term of this patent is extended or adjusted under 35 U.S.C. 154(b) by 0 days.

(21) Appl. No.: 09/913,520

(22) PCT Filed: Feb. 17, 2000

(86) PCT No.: PCT/NL00/00099

§ 371 (c)(1),
(2), (4) Date: May 14, 2003

(87) PCT Pub. No.: WO00/48762

PCT Pub. Date: Aug. 24, 2000

(30) Foreign Application Priority Data

Feb. 17, 1999 (NL) ..... 1011330

(51) Int. Cl.[7] ..... B21D 7/00
(52) U.S. Cl. ..... 72/369; 72/370.22
(58) Field of Search ..... 72/61, 62, 369, 72/370.2, 370.21, 370.22; 29/890.147, 890.149

(56) References Cited

U.S. PATENT DOCUMENTS 1,542,983 A * 6/1925 Bergmann, Jr. ..... 29/890.149
3,348,402 A * 10/1967 Reistad ..... 72/369

FOREIGN PATENT DOCUMENTS

| | | |
|---|---|---|
| DE | 4428564 | 6/1995 |
| EP | 0770435 | 5/1997 |
| JP | 61086029 | 5/1986 |
| JP | 08192238 | 7/1995 |
| JP | 07214147 | 8/1995 |

OTHER PUBLICATIONS

Patent Abstracts of Japan, vol. 010, No. 261 (M–514), Sep. 5, 1986 & JP 61 086029A.

Patent Abstracts of Japan, vol. 1995, No. 11, Dec. 26, 1995 & JP 07 214147A.

Patent Abstracts of Japan, vol. 1996, No. 11, Nov. 29, 1996 & JP 08 192238A.

Machine Translation of Japanese Patent No. 07–214147, published Aug. 15, 1995, in the name of Nakamura Masanobu.

* cited by examiner

*Primary Examiner*—Lowell A. Larson
(74) *Attorney, Agent, or Firm*—Stevens, Davis, Miller & Mosher, LLP

(57) ABSTRACT

Process for deforming a piece of thin-walled metal tube, comprising the operations of bending the piece of tube with respect to its original axis, in which process the wall of the piece of tube is firstly provided, at least at the location where the bend is intended to be, with a deformation which extends substantially in the longitudinal direction of the piece of tube, and in which process wall material is moved closer to the neutral plane of bending, and the piece of tube is then bent, after which the ultimate shape of the piece of tube which is to be deformed is imposed by hydroforming.

11 Claims, 1 Drawing Sheet

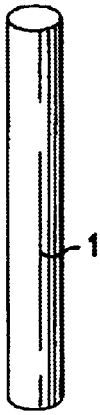
FIG. 1a
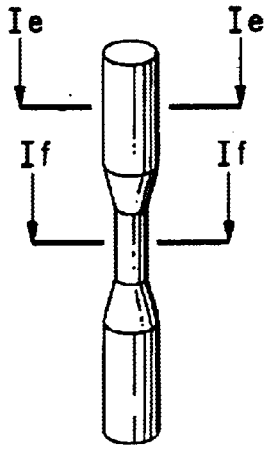
FIG. 1b
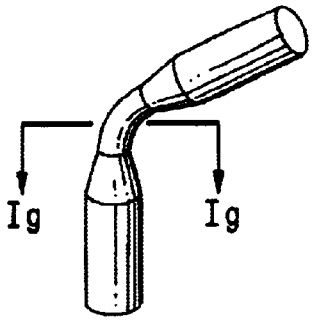
FIG. 1c
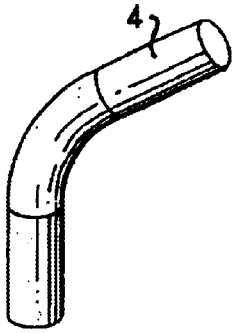
FIG. 1d
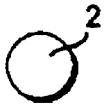
FIG. 1e
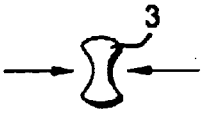
FIG. 1f
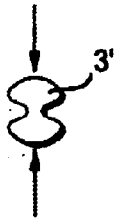
FIG. 1g
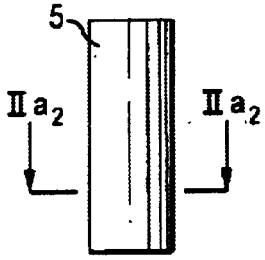
FIG. $2a_1$
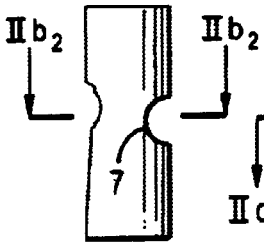
FIG. $2b_1$
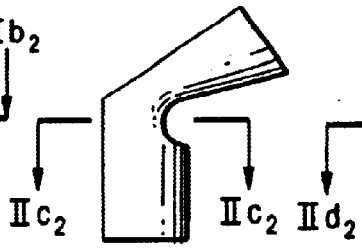
FIG. $2c_1$
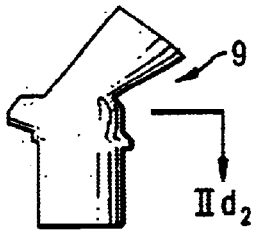
FIG. $2d_1$
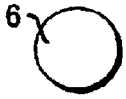
FIG. $2a_2$
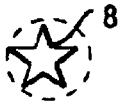
FIG. $2b_2$
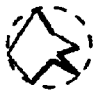
FIG. $2c_2$
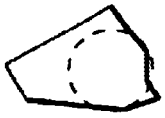
FIG. $2d_2$

PROCESS FOR DEFORMING A PIECE OF THIN-WALLED METAL TUBE

The invention relates to a process for deforming a piece of thin-walled metal tube, comprising the steps of bending the piece of tube with respect to its original longitudinal axis and then hydroforming the piece of tube at least at the location where it has been bent in this way.

A known method for deforming pieces of tube comprises what is known as hydroforming. In this process, the wall of the piece of tube is pressed against a mould piece under the influence of water pressure, so that the piece of tube acquires its ultimate shape. The hydroforming technique is generally known and therefore does not require any further explanation here. If the piece of tube is also to be bent, a bending operation is carried out prior to and separately from the hydroforming step, in which case the bent piece of tube then acquires its ultimate, desired shape through hydroforming. In this way, numerous very complicated shapes can be produced, which are used in engineering, for example in the automotive industry.

It has been found that, in this processing method, the bending of the piece of tube forms a critical step. Particularly if a small wall thickness is used for the piece of tube, cracks are rapidly formed along the outside of the bend during the bending operation, while wrinkles are formed in the compressed region along the inside of the bend. These wrinkles in this case occur in the circumferential direction of the piece of tube, i.e. they run in a direction which is transverse with respect to the longitudinal axis of the piece of tube. If the bent piece of tube is then subjected to a hydroforming operation, it is found that wrinkles of this nature running in the circumferential direction can no longer be removed. The result is an unacceptable product.

JP-61-086029-A discloses a process for deforming a metal tube of the above mentioned kind which involves a pressure-crushing step prior to the bending of the tube. In this pressure-crushing step, the tube is fitted into a hole of a crushing device, which has the same diameter as the outer diameter of the tube, and then a punch is driven against the tube wall at the location, where the tube is to be bent in the later bending step. Thereby the section of the tube, which comes into contact with the punch, is pressure-crushed and brought into close contact with the pipe wall on the opposite side. After this pressure-crushing step the tube is inserted into a hole of a tube bending device such that the straight tube wall part, to which the pressure-crushed section of the tube wall of the tube has been brought into contact, is positioned so as to abut a crest-form apex part of the lower edge surface of the hole. Then a punch is driven through a hole of the die against the pressure-crushed section of the tube wall whereby the tube is bent along the crest-form apex part.

In this prior art process generation of creases is said to be avoided in the bending step, since the wall sections of the tube abutting the crest-form apex part are pinched-pressured from both sides during the bending process. However, in the pressure-crushing step the wall section has to be deformed to a high extent in order to bring it into close contact with the wall section on the opposite side. Accordingly this process is hardly applicable to thin-walled tubes.

Therefore, the object of the invention is to provide a method in which the production of bent, thin-walled pieces of tube and of products formed using such pieces of tube causes fewer problems. In particular, it is intended to reduce the risk of cracking and to avoid the formation of wrinkles in the circumferential direction.

In the process described in the preamble, this is achieved if the piece of tube, before it is bent, is indented on both the inside and the outside of the bend which is to be formed at the location where it will exhibit a bend as a result of the bending operation.

As a result of the indentation, which involves moving wall material closer to the neutral plane of bending stresses, the piece of tube can be bent more easily, with the result that the risk of cracking and the formation of wrinkles in the circumferential direction is reduced considerably. The ultimate shape of the piece of tube which is to be deformed can then be imposed during the subsequent hydroforming operation, during which any deformations which may have been imposed in the longitudinal direction can be eliminated, or further deformations can be produced. It should be noted that, surprisingly, it has been found that wrinkles in the wall of the bent piece of tube which run in the longitudinal direction, i.e. more or less parallel to the axis of the piece of tube, are no longer visible after the hydroforming has taken place.

The process can be used in order to impart a constant cross section to the deformed piece of tube along its length, in that the undeformed piece of tube is firstly provided with longitudinal wrinkles on either side of the neutral plane as a result of compression, and then, after the bending operation, the constant cross section is restored by the hydroforming step. It has been found that in this way pieces of thin-walled tube with a constant cross section and a relatively small radius of curvature can be produced successfully. In the past, the production of pieces of tube of this nature caused considerable problems.

BRIEF DESCRIPTION OF THE DRAWINGS

FIG. 1*a* shows a straight piece of tube;

FIG. 1*b* shows the piece of tube of FIG. 1*a* after the tube's wall has been compressed from either side half-way along the piece of tube;

FIG. 1*c* shows the piece of tube of FIG. 1*b* bent;

FIG. 1*d* shows a bend piece made from hydroforming the tube of FIG. 1*c*;

FIG. 1*e* shows the cross-section along view Ie—Ie of FIG. 1*b*

FIG. 1*f* shows the cross-section along view If—If of FIG. 1*b;*

FIG. 1*g* shows the cross-section along view Ig—Ig of FIG. 1*c;*

FIG. $\mathbf{2}a_1$ a front view of a piece of tube;

FIG. $\mathbf{2}a_2$ shows a cross section along view $\mathrm{IIa}_2$—$\mathrm{IIa}_2$ through the piece of the tube of FIG. $\mathbf{2}a_1$.

FIG. $\mathbf{2}b_1$ a front view of the piece of tube of FIG. $\mathbf{2}a_1$ wherein at location 7, longitudinal wrinkles are pressed into the tube at location 7;

FIG. $\mathbf{2}b_2$ shows a cross section along view $\mathrm{IIb}_2$—$\mathrm{IIb}_2$ through a piece of the tube of FIG. $\mathbf{2}b_1$.

FIG. $\mathbf{2}c_1$ shows a front view of a shape obtained through bending of the piece of tube of FIG. $\mathbf{2}b_2$.

FIG. $\mathbf{2}c_2$ shows a cross section view along view $\mathrm{IIc}_2$—$\mathrm{IIc}_2$ through the piece of the tube of FIG. $\mathbf{2}c_2$.

FIG. $\mathbf{2}d_1$ shows a side view of the product obtained by hydroforming the bent tube of FIG. $\mathbf{2}c_1$.

FIG. $\mathbf{2}d_2$ shows a cross section along view $\mathrm{IId}_2$—$\mathrm{IId}_2$ through the product of FIG. $\mathbf{2}d_1$.

DESCRIPTION OF PREFERRED EMBODIMENTS

In one embodiment of the process according to the invention, the piece of tube, after the indenting step and before and/or after the bending step, is deformed in such a manner that at least part of the material which forms the piece of tube, which part, as seen in cross section through the piece of tube, is situated in a region between regions where the piece of tube is indented, is moved closer to the centre of gravity of the cross section. This further reduces the risk of cracking and/or wrinkling.

The invention will now be explained with reference to a number of figures.

FIGS. 1*a–d* show the production of a bend piece of constant cross section from a straight piece of tube.

FIG. 2 shows the production of a tubular product of complicated shape from a straight piece of tube.

In FIGS. 1, *a, b, c* and d illustrate various phases of the production of the bend piece 4. In FIG. 1*a*, reference numeral 1 denotes a straight piece of tube which is to be formed into the bend piece 4 shown in FIG. 1*d*.

FIG. 1*b* shows the piece of tube 1 with cross section 2 after the wall has been compressed from either side half-way along the piece of tube, with the result that wall wrinkles are formed in the longitudinal direction. The cross section of the piece of tube at the location of these longitudinal wrinkles is indicated by 3. The arrows which are directed towards one another diagrammatically indicate the indentation according to the invention. Arrows directed towards one another at 3' indicate any further deformation of the piece of tube before or after bending FIG. 1*c* shows how the piece of tube can easily be bent at the location of the thinned middle piece, partly as a result of the considerable reduction in the section modulus of the cross section at that location. The risk of cracks or wrinkles in the circumferential direction occurring is considerably reduced as a result. The shape shown in FIG. 1*d* can be obtained by subjecting the product shown in FIG. 1*c* to a hydroforming operation.

FIG. 2 illustrates the production of a workpiece with a more complicated shape. In FIGS. 2*a*1 and *a*2, a front view of and a cross section through a piece of tube are illustrated. FIGS. 2*d*1 and *d*2 show a side view of and a cross section through the product 9 formed therefrom. At location 7, longitudinal wrinkles are pressed into the piece of tube 5, with the result that a cross section of the shape of 8 is formed at that location (cf. FIGS. 2*b*1 and *b*2). The shape shown in FIGS. 2*c*1 and *c*2 is obtained through bending of the piece of tube.

From this, the final shape 9 can be obtained by hydroforming; numerous variations on this shape are conceivable.

What is claimed is:

1. A process for deforming a piece of a thin-walled metal tube, comprising the steps of:

bending the piece of tube with respect to an original longitudinal axis of the piece of tube, and then hydroforming the piece of tube at least at the location where the piece of tube has been bent, compressing the piece of tube prior to the bending step at the location where the piece of tube will exhibit the bend as a result of the bending step so as to form a wrinkle comprising a longitudinal indentation, which runs substantially parallel to the longitudinal axis of the tube on the outside of the bend to be formed, wherein in the compression step prior to the bending step at least one said longitudinal wrinkle is formed at the outside of the bend and at least one said longitudinal wrinkle is formed at the inside of the bend on either side of a neutral plane of bending stresses of the bend, thereby moving wall material on both sides of the neutral plane closer to the neutral plane, wherein the tube prior to bending defines a transverse perimeter of a cross-section of the tube, the transverse perimeter is transverse to the longitudinal axis of the tube and passes through the longitudinal wrinkles, wherein the transverse perimeter has at least one indented portion formed respectively by said at least one wrinkle formed at the outside of the bend and at least one indented portion formed respectively by said at least one wrinkle formed at the inside of the bend, such that at least one indented portion is located on either side of the neutral plane of bending stresses of the bend, wherein prior to said bending some points of said transverse perimeter are further from the longitudinal axis of the tube than other points of the transverse perimeter, wherein the neutral plane passes perpendicularly through the transverse cross section prior to the bending;

wherein the transverse perimeter after forming the longitudinal wrinkles, but prior to bending, includes portions which overlap a second transverse perimeter of a portion of the tube which is not compressed.

2. The process of claim 1, wherein the transverse perimeter at a longitudinal midpoint of at least one said longitudinal indentation, prior to bending, includes said portions which overlap said second transverse perimeter of said portion of the tube which is not compressed.

3. The process of claim 1, wherein after said compressing but prior to said bending, the length of the transverse perimeter of the tube is constant along the entire length of the tube.

4. The process of claim 1, wherein after said compressing but prior to bending, the length of the transverse perimeter of the tube including the indented portions equals the length of a second transverse perimeter of a section of the tube which is not compressed.

5. The process of claim 1, wherein each said indented portion does not touch any other indented portion.

6. The process of claim 1, wherein each said indented portion does not touch any other indented portion.

7. The process of claim 1, consisting of said bending, hydroforming and compressing steps.

8. A process for deforming a piece of a thin-walled metal tube, comprising the steps of:

bending the piece of tube with respect to an original longitudinal axis of the piece of tube, and then hydroforming the piece of tube at least at the location where the piece of tube has been bent, compressing the piece of tube prior to the bending step at the location where the piece of tube will exhibit the bend as a result of the bending step so as to form a wrinkle comprising a longitudinal indentation, which runs substantially parallel to the longitudinal axis of the tube on the outside of the bend to be formed, wherein in the compression step prior to the bending step at least one said longitudinal wrinkle is formed at the outside of the bend and at least one said longitudinal wrinkle is formed at the inside of the bend on either side of a neutral plane of bending stresses of the bend, thereby moving wall material on both sides of the neutral plane closer to the neutral plane, wherein the tube prior to bending defines a transverse perimeter of a cross-section of the tube, the transverse perimeter is transverse to the longitudinal axis of the tube and passes through the longitudinal wrinkles, wherein the transverse perimeter has at least one indented portion formed respectively by said at least one wrinkle formed at the outside of the bend and at least one indented portion formed respectively by said at least one wrinkle formed at the inside of the bend, such that at least one indented portion is located on either side of the neutral plane of bending stresses of the bend, wherein prior to said bending some points of said transverse perimeter are further from the longitudinal axis of the tube than other points of the transverse perimeter, wherein the neutral plane passes perpendicularly through the transverse cross section prior to the bending;

wherein the tube following hydroforming has a constant transverse cross-section along its entire length.

9. The process of claim 8, consisting of said bending, hydroforming and compressing steps.

10. A process for deforming a piece of a thin-walled metal tube, comprising the steps of:

bending the piece of tube with respect to an original longitudinal axis of the piece of tube, and then hydroforming the piece of tube at least at the location where the piece of tube has been bent, compressing the piece of tube prior to the bending step at the location where the piece of tube will exhibit the bend as a result of the bending step so as to form a wrinkle comprising a longitudinal indentation, which runs substantially parallel to the longitudinal axis of the tube on the outside of the bend to be formed, wherein in the compression step prior to the bending step at least one said longitudinal wrinkle is formed at the outside of the bend and at least one said longitudinal wrinkle is formed at the inside of the bend on either side of a neutral plane of bending stresses of the bend, thereby moving wall material on both sides of the neutral plane closer to the neutral plane, wherein the tube prior to bending defines a transverse perimeter of a cross-section of the tube, the transverse perimeter is transverse to the longitudinal axis of the tube and passes through the longitudinal wrinkles, wherein the transverse perimeter has at least one indented portion formed respectively by said at least one wrinkle formed at the outside of the bend and at least one indented portion formed respectively by said at least one wrinkle formed at the inside of the bend, such that at least one indented portion is located on either side of the neutral plane of bending stresses of the bend, wherein prior to said bending some points of said transverse perimeter are further from the longitudinal axis of the tube than other points of the transverse perimeter, wherein the neutral plane passes perpendicularly through the transverse cross section prior to the bending;

wherein the transverse perimeter of the cross-section of the tube prior to bending defines a five pointed star.

11. The process of claim 10, consisting of said bending, hydroforming and compressing steps.

* * * * *